United States Patent [19]

Tortell

[11] 4,450,782

[45] May 29, 1984

[54] NEEDLEWORK FLOWER STITCH

[76] Inventor: Liliana Tortell, 3524 E. Avenue R, #113, Palmdale, Calif. 93550

[21] Appl. No.: 507,521

[22] Filed: Jun. 24, 1983

[51] Int. Cl.[3] ..... D05B 97/00

[52] U.S. Cl. ..... 112/266.1; 112/410; 112/439; 28/164

[58] Field of Search ..... 112/266.1, 266.2, 409, 112/410, 439, 412, 400; 28/164

[56] References Cited

U.S. PATENT DOCUMENTS

| | | | |
|---|---|---|---|
| 379,402 | 3/1888 | Lamb et al. | 112/266.1 X |
| 402,468 | 4/1889 | Merrow | 112/266.1 |
| 424,568 | 4/1890 | Morley | 112/409 |
| 507,235 | 10/1893 | Merrow | 112/266.1 X |
| 578,917 | 3/1897 | Drolet | 112/410 |

FOREIGN PATENT DOCUMENTS

| | | | |
|---|---|---|---|
| 176739 | 11/1953 | Austria | 112/266.1 |
| 845130 | 5/1939 | France | 112/266.1 |

*Primary Examiner*—H. Hampton Hunter

*Attorney, Agent, or Firm*—Allan D. Mockabee

[57] ABSTRACT

A method of producing a dimensional scallop stitch to provided a petal-like effect wherein a bar of thread, attached at spaced ends to a piece of cloth, provides an anchor for a series of loops of thread, wherein the loops are formed by passing a threaded needle repeatedly beneath and around the bar of thread with the outer ends of the loops spaced from the bar of thread and the loops interlocked with a next succeeding loop, filling the bar of the thread with loops until those portions of the loops at the bar are closely confined and the outer ends of the loops are unconfined, whereby a petal-like unit is produced which stands away from the cloth supporting the bar of thread.

3 Claims, 4 Drawing Figures

Fig. 1.
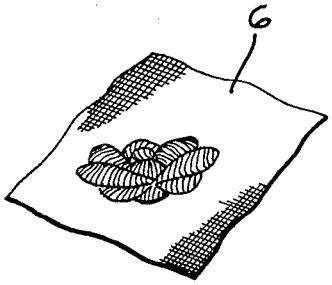
Fig. 2.
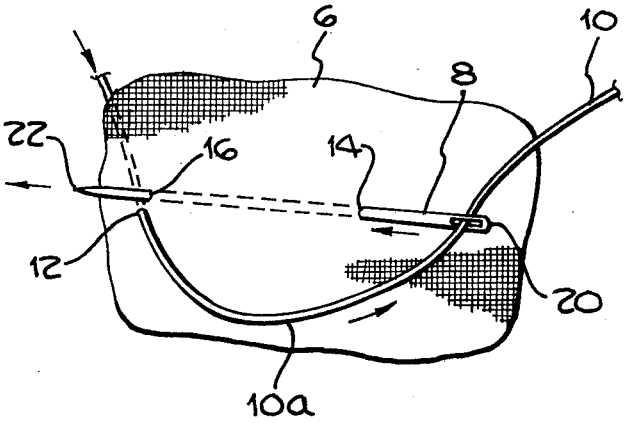
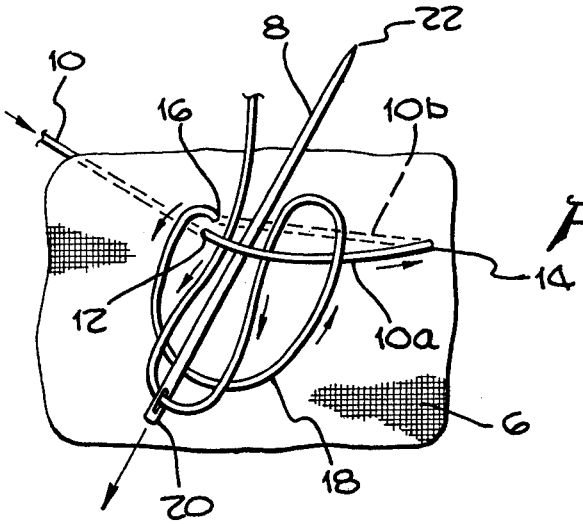
Fig. 3.
Fig. 4.
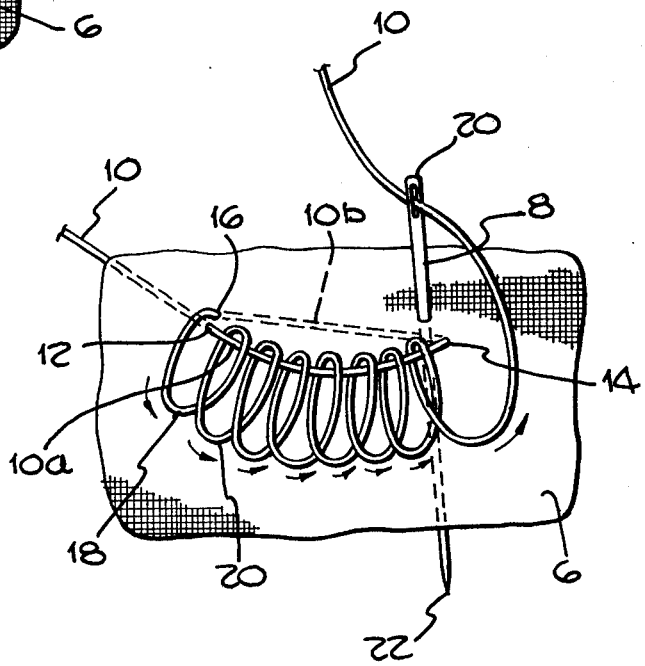

NEEDLEWORK FLOWER STITCH

FIELD OF THE INVENTION

The invention is in the field of needlework and more particularly in the formation, with a needle and thread, of flower-like, or leaf-like shapes wherein the individual petals making up a flower stand away from each other as well as from the underlying piece of cloth.

PRIOR ART

Prior art known is:

| U.S. Pat. No. | Inventor | Filed |
|---|---|---|
| 402,468 | Merrow | April 30, 1889 |
| 424,568 | Morley | April 1, 1890 |
| 578,917 | Drolet | March 16, 1897 |
| 1,409,214 | Einstein | March 14, 1922 |
| 1,616,421 | Loeb | February 1, 1927 |
| 1,718,156 | Langa | June 18, 1929 |
| 4,250,823 | Maum | February 17, 1981 |
| German 282,834 | Hoffmann | June 1913 |
| French 845,130 | Margot | August 1939 |
| Austrian 176,741 | Schmid | November 1953 |
| Austrian 176,739 | Heuschneider-Heinzle | November 1953 |
| French 563,885 | Kuhlmann | October 1923 |

All the above patents show various methods of producing certain kinds of stitches, some of which are composed of loops of thread. However, the inner ends of the loops all are anchored to the cloth about the entire edge of a piece of cloth as in Loeb and are not formed about a bar of thread of a given length which has its ends only anchored to the piece of cloth.

In the patent to Merrow, loops of cloth are arranged in groups, the loops of a group all radiating from a common point rather than being formed about a bar of thread as stated above.

Drolet shows lines of loops wherein each loop is formed about an elongated piece of thread, but the loops passes through the supporting cloth and not merely beneath and around the bar of thread. This is also true of Austrian Pat. No. 176,741. And a similar arrangement is shown in the German patent where loops are formed through the cloth along lines formed by printing circles or the like on the cloth base.

The other patents noted above, all show various types of stitching or edging, but none shows the formation of loops about the bar of thread which is secured to the cloth base only at the ends of the bar and beneath and about which a number of loops are formed.

Also, there appears to be nothing in the art which shows a manner of forming loops of thread which interlock and have their base portions adjacent the cloth in a more confined space than those portions of the loop remote from the cloth, wherein a flower, leaf or petal-like formation results and the leaf- or petal-like unit, along its outer edge, tends to curl or stand away from the underlying cloth or from leaves or petals therebeneath.

DESCRIPTION

The invention will become apparent from the following description in connection with the accompanying drawing.

FIG. 1 is a perspective view of a piece of cloth with an illustrative embodiment of my invention thereon.

FIG. 2 is a view on an enlarged scale, of the manner in which the bar of thread is formed.

FIG. 3 is a plan view of a piece of cloth showing the manner in which a threaded needle is fed beneath and about the bar of cloth.

FIG. 4 is a plan view of a piece of cloth showing a number of coils which have been formed beneath and about the bar of thread, the coils of thread being shown in spaced relationship along the bar merely for purposes of illustration.

Any suitable piece of cloth 6 can be used for the basic material upon which the stitching is made. The cloth 6 is shown in FIG. 2 with a needle 8 and thread 10, the needle first being passed through the thread from back to front at point 12 and then passed through the thread from front to back at point 14. Again the needle is passed through the cloth from back to front at point 16 adjacent the first point of passage 12. As shown in FIGS. 3 and 4, the thread portion **10*a* on the front side of the cloth between points 12 and 14 is a bar of thread 10*a* about which the loops of my stitch are to be formed. There is a portion of the thread 10*b* which is located at the back or underside of the cloth 6 more or less coincidental with the location and length of the bar 10*a***.

Where the thread is reentered from the back of the cloth to the front at point 16, a partially formed loop 18 is provided as shown in FIG. 3. With the looped portion 18 in the position of FIG. 3, the needle 8 is passed beneath the bar of thread **10*a* with the blunt threaded end of the needle 20 in advance of the point 22. This permits ready movement of the needle and the thread it carries beneath the bar of thread 10*a* so that the point of the needle will not catch on the cloth 6**.

When a succeeding loop 20 is formed, the needle is passed backwardly beneath the bar of thread **10*a* at one side of the first formed loop 18. In the manner disclosed herein, the first formed loop 18 is adjacent the left end of the bar of thread 10*a* and succeeding loops 20** are formed from left to right.

It will be noted that when succeeding loops are formed, the needle and its thread is passed beneath the bar of thread **10*a* and thence through the previously formed loop so that the loops are intertwined at points outward from the bar of thread 10*a*. This is continued until the bar 10*a* is provided with a number of rather closely confined loops of thread which are not spaced upon as shown in FIG. 3. When the final loop is formed at the right, the needle can be passed through the cloth 6** from front to back and a suitable knot tied and the extra thread cut off.

By reason of the fact that the loop interconnect and those portions which lie beneath the bar of thread **10*a* are rather closely confined, the remaining portions of the loops will tend to spread lengthwise relative to the bar of thread and the longitudinal confinement created by the bar and the tendency of the loops to expand at their outer portions, will cause the petal-like formation of stitches to tend to curl or stand out from the underlying cloth 6**. Also, when a number of petals are superimposed in somewhat outwardly concentric position or relationship, there is a definite three dimensional effect produced by the tendency of the petals to curl or stand out.

It will of course be understood that various changes can be made in the form, details, arrangement and proportions without departing from the spirit of the invention.

I claim:

1. A method for forming a third dimensional scallop stitch which comprises:

forming one end of a bar of thread on a piece of cloth by passing a threaded needle through the cloth from the back of the cloth, forming the other end of the bar by passing the threaded needle through the cloth from the front of the cloth a predetermined distance from said one end of said bar of thread, providing a petal-like unit by forming loops about the bar of thread by passing the threaded needle repeadedly under and around the bar of thread and above said cloth whereby said loops are secured only to said bar of thread.

and continuing the formation of loops on the bar of thread until the portions of the loops immediately adjacent the bar of thread are confined between the end of said bar of thread in close relationship to each other, free portions of said loops remote from said bar of thread being relatively unconfined and disposed generally along a line longer than that of said bar of thread, whereby the confined portions of the loop will cause the free loop portions of the petal-like unit to tend to stand away from the cloth carrying the bar of thread.

2. The method of claim 1, wherein the threaded needle is passed repeatedly under and around the bar of thread with the unpointed blunt end of the needle ahead of the pointed end thereof.

3. The method of claim 1, wherein the needle and the thread thereon is passed through a preceding loop of thread after the needle has been passed under and around the bar of thread.

* * * * *